US005388279A

United States Patent [19]

Rasmussen

[11] Patent Number: 5,388,279

[45] Date of Patent: Feb. 14, 1995

[54] TODDLER URINAL

[76] Inventor: Estelle B. Rasmussen, 24 Westview, Hamilton, Ill. 62341

[21] Appl. No.: 261,175

[22] Filed: Jun. 13, 1994

[51] Int. Cl.[6] ..... A47K 11/12

[52] U.S. Cl. ..... 4/144.1; 4/476; 4/479

[58] Field of Search ..... 4/144.1, 476, 479, 481, 4/DIG. 5, 341, 342, 301, 462

[56] References Cited

U.S. PATENT DOCUMENTS

| | | | |
|---|---|---|---|
| D. 316,748 | 5/1991 | Penn | D23/302 |
| D. 318,325 | 7/1991 | McKinley | D23/302 |
| 2,073,390 | 3/1937 | Giblette | 4/DIG. 5 |
| 2,153,866 | 4/1939 | Hess | 4/476 |
| 2,592,040 | 4/1952 | La Hue | 4/DIG. 5 |
| 2,719,305 | 10/1955 | La Hue | 4/DIG. 5 |
| 2,769,982 | 11/1956 | Gossett | 4/144.1 |
| 3,297,858 | 1/1967 | Blankenship | 4/144.1 |
| 5,040,248 | 8/1991 | Kelly | 4/462 |
| 5,044,020 | 9/1991 | Lewandowski et al. | 4/301 |
| 5,313,672 | 5/1994 | Luedtke et al. | 4/301 |

*Primary Examiner*—Henry J. Recla
*Assistant Examiner*—Charles R. Eloshway

[57] ABSTRACT

A toddler urinal comprising a receptacle having a top end, a bottom end, and an open urine deposition cavity disposed therebetween and bounded by a backboard adapted for containing urine sprayed therein; a drain disposed through the urine deposition cavity and extended downwards and through the bottom end of the receptacle; and a open vessel disposed under the drain for collecting urine.

1 Claim, 3 Drawing Sheets

TODDLER URINAL

BACKGROUND OF THE INVENTION

1. Field of the Invention

The present invention relates to a toddler urinal and more particularly pertains to training male toddlers to urinate while standing with a toddler urinal.

2. Description of the Prior Art

The use of urinals is known in the prior art. More specifically, urinals heretofore devised and utilized for the purpose of training male toddlers to urinate while standing are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 316,748 to Penn discloses a toddler's urinal.

U.S. Pat. Des. No. 318,325 to McKiney discloses a training urinal.

U.S. Pat. No. 5,040,248 to Kelly discloses a stand-up training potty for male toddlers.

U.S. Pat. No. 5,044,020 to Lewandowski discloses a urinal for convenience and training of juvenile males.

U.S. Pat. No. 5,148,553 to Jermann discloses a child's urinal for hanging on side of toilet.

While these devices fulfill their respective, particular objective and requirements, the aforementioned patents do not describe a toddler urinal that is uniquely adapted for use by a male toddler and includes a pan that allows easily collection and disposal of urine.

In this respect, the toddler urinal according to the present invention substantially departs from the conventional concepts and designs of the prior art, and in doing so provides an apparatus primarily developed for the purpose of training male toddlers to urinate while standing.

Therefore, it can be appreciated that there exists a continuing need for a new and improved toddler urinal which can be used for training male toddlers to urinate while standing. In this regard, the present invention substantially fulfills this need.

SUMMARY OF THE INVENTION

In the view of the foregoing disadvantages inherent in the known types of urinals now present in the prior art, the present invention provides an improved toddler urinal. As such, the general purpose of the present invention, which will be described subsequently in greater detail, is to provide a new and improved toddler urinal and method which has all the advantages of the prior art and none of the disadvantages.

To attain this, the present invention essentially comprises, in combination, an essentially box-shaped receptacle having opposed top and bottom surfaces, opposed front and rear walls and opposed side walls extended between the top and bottom surfaces, and a generally oblong and open urine deposition cavity formed through the front wall and bounded by a concave backboard adapted for containing urine sprayed therein. A box-shaped urine collection cavity is formed through the front wall of the receptacle below the urine deposition cavity and bounded by opposed upper and lower walls, opposed side walls, and a rear wall extended between the upper and lower walls with each side wall having a lateral guiding channel formed thereon. A drain is disposed through the receptacle from the urine deposition cavity to the urine collection cavity. A perforated drain cover is extended across the drain. A handle is formed of a ring with hand grip peripherally extended therefrom. A bowl is disposed within the ring of the handle to define a pan with the pan adapted to be slidably disposed within the urine collection cavity such that the ring of the handle is mated with the guiding channels and the bowl is positioned upon the lower wall directly under the drain for collecting urine. Lastly, four adjustable legs are extended from the bottom surface of the receptacle with the legs adapted to be positioned at a height for allowing a male toddler to urinate into the urine deposition cavity. Each leg has a foot with a top surface and a bottom surface, a cylindrical and threaded portion extended upwards from the top surface of the foot and disposed through the receptacle near a separate corner thereof, and a rubber pad disposed on the bottom surface of the foot to keep the foot from sliding.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toddler urinal which has all the advantages of the prior art urinals and none of the disadvantages.

It is another object of the present invention to provide a new and improved toddler urinal which may be easily and efficiently manufactured and marketed.

It is a further object of the present invention to provide a new and improved toddler urinal which is of durable and reliable construction.

An even further object of the present invention is to provide a new and improved toddler urinal which is susceptible of a low cost of manufacture with regard to both materials and labor, and which accordingly is then susceptible of low prices of sale to the consuming public, thereby making such a toddler urinal economically available to the buying public.

Still yet another object of the present invention is to provide a new and improved toddler urinal which provides in the apparatuses and methods of the prior art some of the advantages thereof, while simultaneously overcoming some of the disadvantages normally associated therewith.

Even still another object of the present invention is to provide a new and improved toddler urinal for training male toddlers to urinate while standing.

Lastly, it is an object of the present invention to provide a new and improved toddler urinal comprising a receptacle having a top end, a bottom end, and an open urine deposition cavity disposed therebetween and bounded by a backboard adapted for containing urine sprayed therein; a drain disposed through the urine deposition cavity and extended downwards and through the bottom end of the receptacle; and a open vessel disposed under the drain for collecting urine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
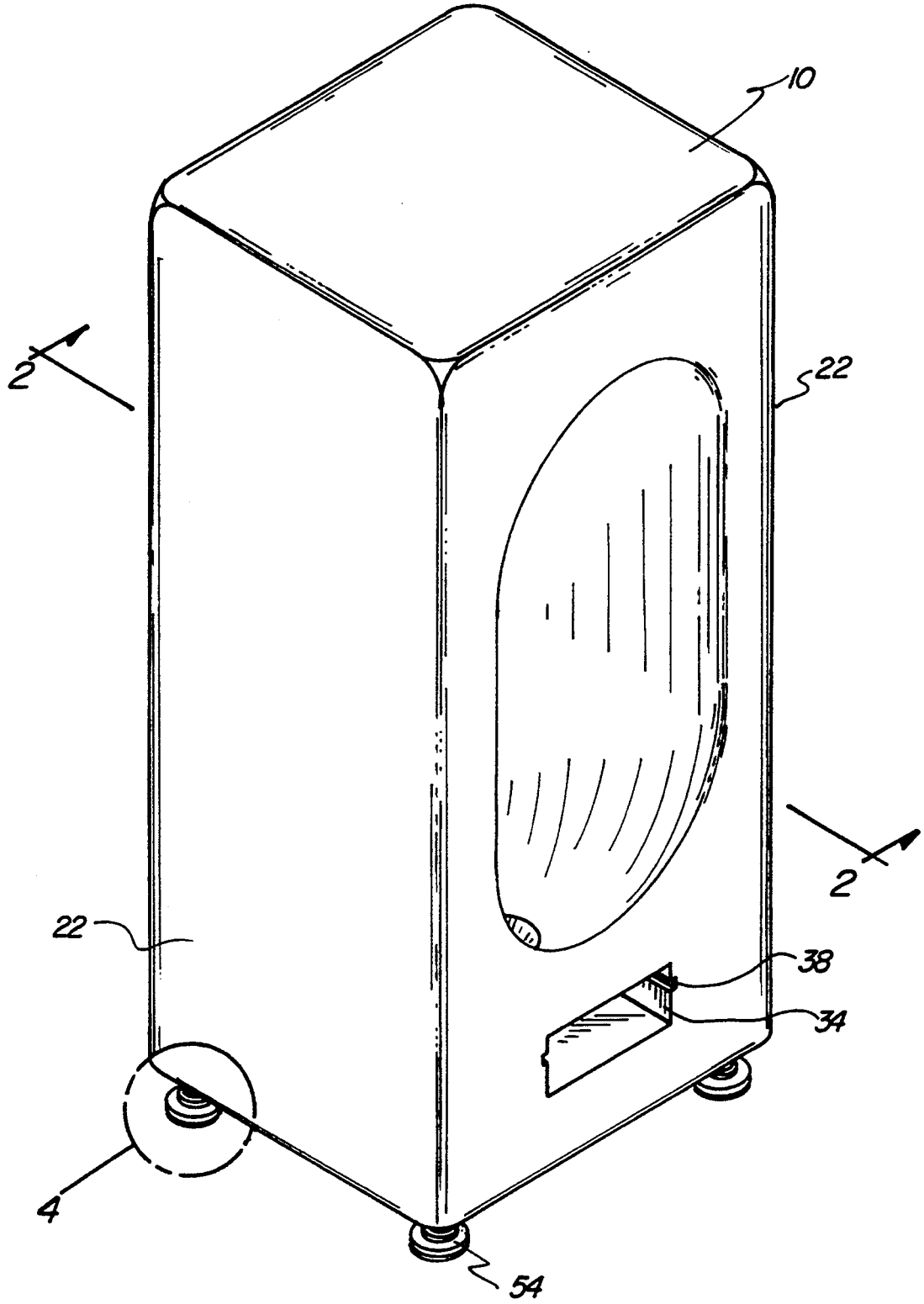
FIG. 1 is a perspective view of the preferred embodiment of the toddler urinal constructed in accordance with the principles of the present invention.
Figure 2:
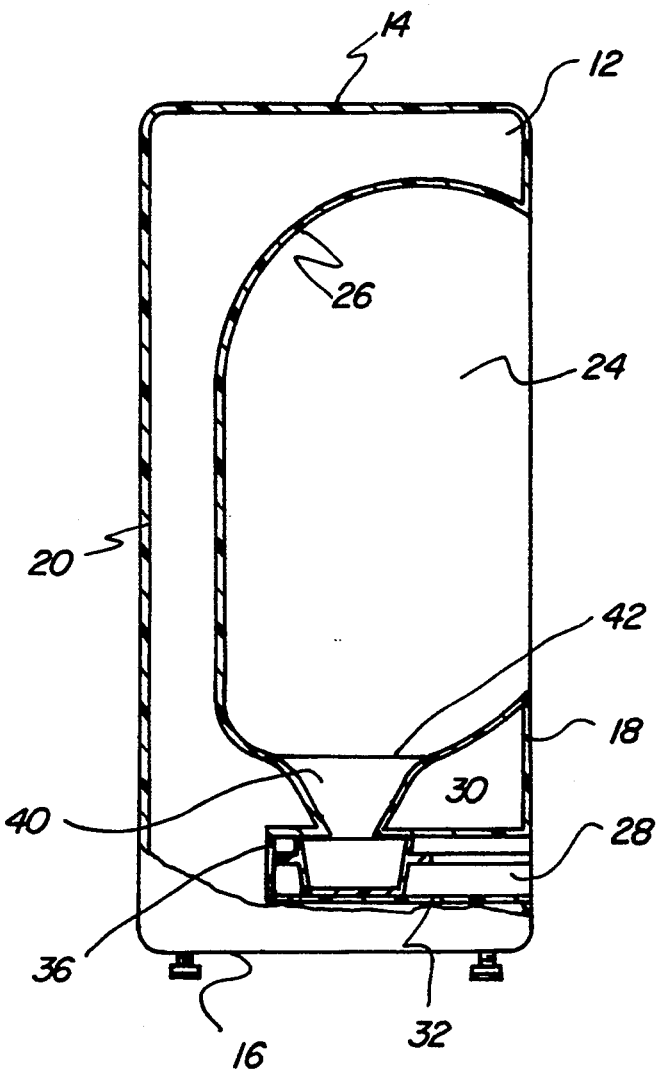
FIG. 2 is a cross-sectional view of the present invention taken along the line 2—2 of FIG. 1.
Figure 5:
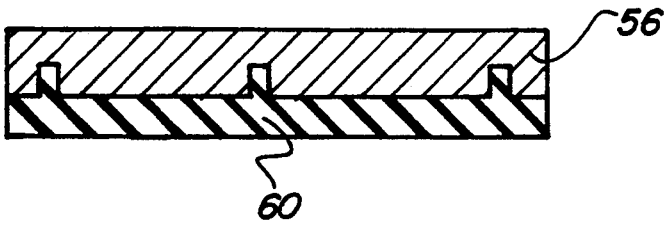
FIG. 5 is a cross-sectional view of an adjustable leg of the present invention taken along the line 5—5 of FIG. 4.
Figure 4:
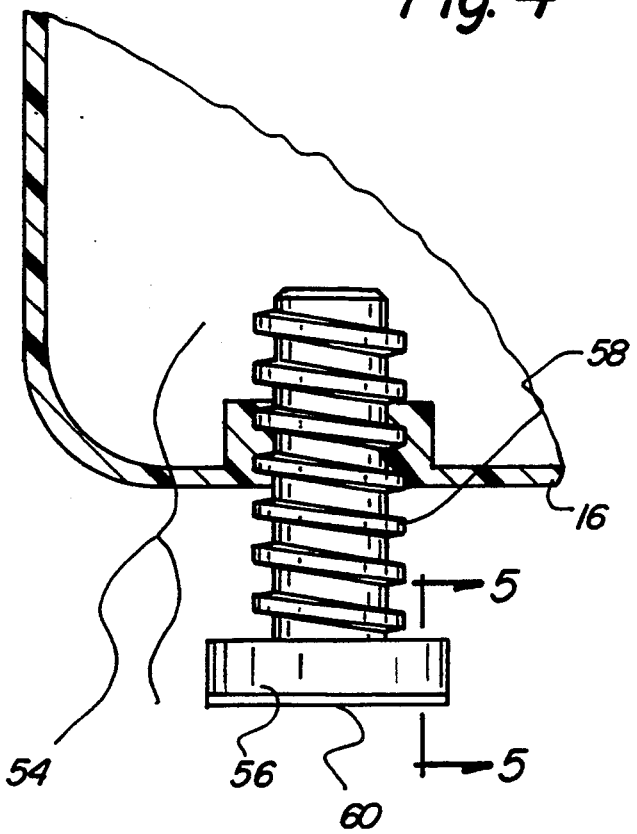
FIG. 4 is a cross-sectional view of an adjustable leg of the present invention shown in FIG. 1.
Figure 3:
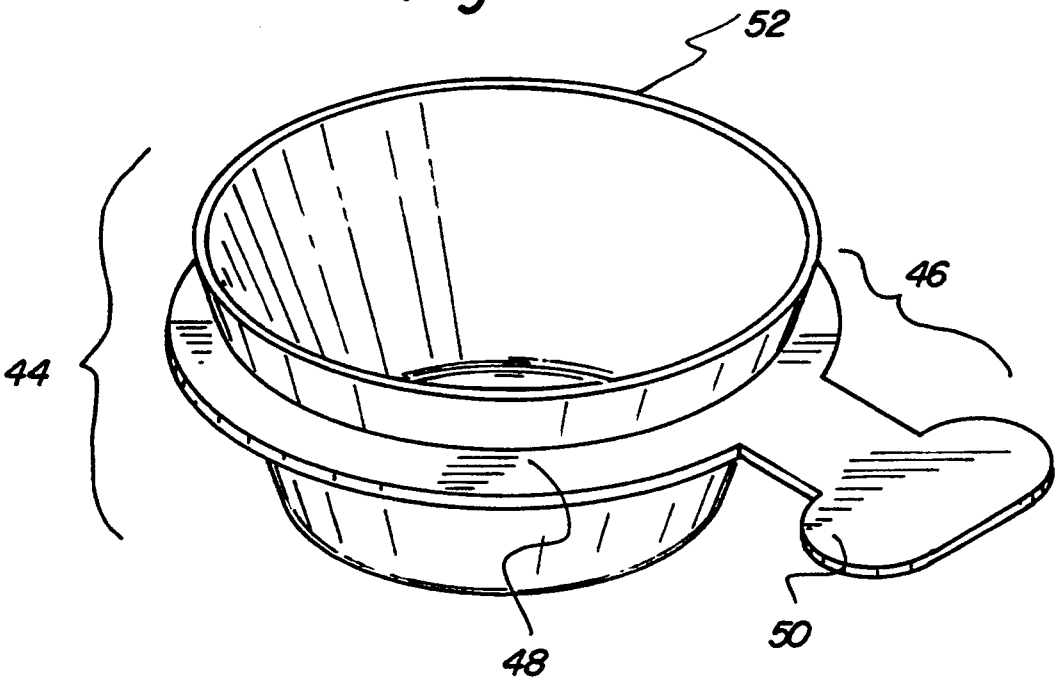
FIG. 3 is a perspective view of the pan used to collect urine.

With reference now to the drawings, and in particular, to FIG. 1 thereof, the preferred embodiment of the new and improved toddler urinal embodying the principles and concepts of the present invention and generally designated by the reference number 10 will be described.

Specifically, the present invention includes four major components. The major components are the receptacle, drain cover, pan, and legs. These components are interrelated to provide the intended function.

More specifically, it will be noted in the various Figures that the first major component is the receptacle 12. The receptacle is essentially box-shaped and rigid in structure. It is formed of a material impervious to staining or corrosion caused by urine. The receptacle has opposed top and bottom surfaces 14, 16. The receptacle also has opposed front and rear walls 18, 20 and opposed side walls 22 extended between the top and bottom surfaces. The receptacle includes a generally oblong and open urine deposition cavity 24 formed through the front wall. The urine deposition cavity is bounded by a generally concave back board 26. This backboard is adapted for containing urine sprayed therein from a location remote from the receptacle. The receptacle includes a box-shaped urine collection cavity 28. The urine collection cavity is formed through the front wall of the receptacle below the urine deposition cavity. The urine collection cavity is bounded by opposed upper and lower walls 30, 32, opposed side walls 34, and a rear wall 36 extended between the upper and lower walls. Each side wall of the urine collection cavity has a lateral guiding channel 38 formed thereon. The guiding channels are positioned on each side wall such that they are planarly aligned. Lastly, a drain 40 is disposed through the receptacle from the urine deposition cavity 24 to the urine collection cavity 28. The drain is adapted to direct the flow of urine sprayed into the urine deposition cavity to the urine collection cavity for subsequent collection.

The second major component is the drain cover 42. The drain cover is perforated and rigid in structure. It is extended across the drain. The drain cover is adapted to restrict the movement of particulates larger than the perforations formed therethrough such as cigarette butts or paper from being transferred to the urine collection cavity.

The third major component is the pan 44. The pan is rigid in structure. The pan is formed of two parts. The first part of the pan is the handle 46. The handle is formed of a ring 48 with a hand grip 50 peripherally extended therefrom. The second part of the pan is the bowl 52. The bowl 52 is deposited within the ring of the handle. The pan is adapted to be slidably disposed within the urine collection cavity 28 such that the ring of the handle is mated within the guiding channels 38 thereof and the bowl is positioned upon the lower wall 32 thereof directly under the drain 40 for collecting urine that is sprayed by a male toddler into the urine collection cavity 24.

The fourth major component is the legs 54. The present invention includes four adjustable legs. The legs are extended downwards from the bottom surface 16 of the receptacle. The legs are adapted to be positioned at a height for allowing a male toddler to urinate into the urine deposition cavity 24. Each leg has a foot 56 with a top surface and a bottom surface. A cylindrical and threaded rod portion 58 is extended upwards from the top surface of the foot and disposed through the receptacle near a separate corner thereof. A rubber pad is disposed on the bottom surface of the foot to keep the foot from sliding.

The present invention is uniquely adapted for training male toddlers to urine while standing. Training male toddlers to urinate standing up is a difficult task for both the toddlers and their parents. If the male toddlers are trained using a conventional toilet bowl, they usually have to stand on a raised platform to urinate into the bowl. The difficulty of training with the platform is exacerbated since the toddler's urine spray usually winds up missing the bowl, causing frustration for the toddler and his parents. Furthermore, there is also a risk of the toilet seat falling while the male toddler is urinating and causing injury. The present invention is adapted to help toilet train male toddlers properly and safely.

The present invention is made of rigid plastic receptacle that measures about 30 inches high by about 18 inches wide by about 18 inches deep. It has the shape of a conventional urinal with a rear wall that curves down and into a drain hole that opens into a rectangular space molded into the base. A separate catch basin or pan fits into the space to catch the urine. Four removable screw-in legs are installed below the receptacle. The legs are adjustable to accommodate different urinating heights of boys. The unit is lightweight and portable and can be temporarily installed in just about any bathroom. It is easily cleaned with a conventional toilet brush and bowl cleaner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A toddler urinal for training male toddlers to urinate while standing comprising, in combination:

an essentially box-shaped receptacle having opposed top and bottom surfaces, opposed front and rear walls and opposed side walls extended between the top and bottom surfaces, a generally oblong and open urine deposition cavity formed through the front wall and bounded by a concave backboard adapted for containing urine sprayed therein, a box-shaped urine collection cavity formed through the front wall of the receptacle below the urine deposition cavity and bounded by opposed upper and lower walls, opposed side walls, and a rear wall extended between the upper and lower walls with each side wall having a lateral guiding channel formed thereon, and a drain disposed through the receptacle from the urine deposition cavity to the urine collection cavity;

a perforated drain cover extended across the drain;

a handle formed of a ring with a hand grip peripherally extended therefrom;

a bowl disposed within the ring of the handle to define a pan with the pan adapted to be slidably disposed within the urine collection cavity such that the ring of the handle is mated with the guiding channels and the bowl is positioned upon the lower wall directly under the drain for collecting urine; and four adjustable legs extended from the bottom surface of the receptacle with the legs adapted to be positioned at a height for allowing a male toddler to Urinate into the urine deposition cavity, each leg having a foot with a top surface and a bottom surface, a cylindrical and threaded portion extended upwards from the top surface of the foot and disposed through the receptacle near a separate corner thereof, and a rubber pad disposed on the bottom surface of the foot to keep the foot from sliding.

* * * * *